United States Patent [19]

Schulte et al.

[11] Patent Number: 4,909,647

[45] Date of Patent: Mar. 20, 1990

[54] EXCHANGEABLY INSERTABLE INK RIBBON CASSETTE FOR A PRINTER

[75] Inventors: Walter Schulte, Olpe; Horst-Werner Bach, Kirburg, both of Fed. Rep. of Germany

[73] Assignee: U.S. Philips Corporation, New York, N.Y.

[21] Appl. No.: 281,567

[22] Filed: Dec. 8, 1988

[30] Foreign Application Priority Data

Dec. 12, 1987 [DE] Fed. Rep. of Germany ..... 3742238

[51] Int. Cl.[4] ..... B41J 33/34

[52] U.S. Cl. ..... 400/208; 400/225; 400/693.1

[58] Field of Search ..... 400/225, 208, 701, 702.1, 400/693.1

[56] References Cited

U.S. PATENT DOCUMENTS

| | | | |
|---|---|---|---|
| 4,023,191 | 5/1977 | Augustin, Jr. et al. | 354/86 |
| 4,581,671 | 4/1986 | Francis et al. | 360/137 |
| 4,636,097 | 1/1987 | Goubeaux | 400/196.1 |
| 4,702,631 | 10/1987 | Watanabe | 400/208 |
| 4,712,931 | 12/1987 | Ohshima | 400/320 |
| 4,725,157 | 2/1988 | Nakai et al. | 400/680 |
| 4,797,018 | 1/1989 | Hofmann et al. | 400/208 |
| 4,803,583 | 2/1989 | Bogdanski | 360/128 |

FOREIGN PATENT DOCUMENTS

| | | | |
|---|---|---|---|
| 3616925 | 4/1987 | Fed. Rep. of Germany | 400/701 |
| 48361 | 3/1985 | Japan | 400/701 |
| 92885 | 4/1987 | Japan | 400/702.1 |
| 176866 | 8/1987 | Japan | 400/701 |

*Primary Examiner*—William Pieprz

[57] ABSTRACT

An exchangeably insertable ink ribbon cassette, for a printer has a storage space for an ink ribbon and a transport device for the ink ribbon that can be driven through a reduction driving gear by an electric motor. The liability to repair of the printer is reduced in that the electric motor (12) and the reduction gear (15, 16) are arranged in a drive housing (6) fixedly integrated with the housing of the ink ribbon cassette and means (7 to 10) are provided for establishing a current connection between the motor (12) and the printer by means of a detachable contact connection.

5 Claims, 1 Drawing Sheet

EXCHANGEABLY INSERTABLE INK RIBBON CASSETTE FOR A PRINTER

BACKGROUND OF THE INVENTION

The invention relates to a printer having an exchangeably insertable ink ribbon cassette, which has a storage space for an ink ribbon and a transport device for the ink ribbon that can be driven by an electric motor through a gear transmission.

In a known cassette of this kind (EP-A 01 58 963), the transport devices are coupled through a coupling brought into engagement upon insertion of the cassette to the reduction driving gear of an electric motor arranged in the printer. The reduction driving gear and the motor must be designed so as to be stable during the whole life of the printer. Nevertheless, disturbances also of these subassemblies of the printer cannot be excluded and must be eliminated, as the case may be, by a skilled technician.

BACKGROUND OF THE INVENTION

The electric motor and the reduction driving gear are arranged in a drive housing fixedly integrated with the housing of the ink ribbon cassette and means are provided for establishing a current connection between the motor and the printer by means of a detachable contact connection.

According to the invention, the electric motor and its gear transmission are no longer component parts of the printer, but of the cassette. In the case of a defect of these elements, only the then defective cassette need be exchanged by an operator, the assistance of a skilled technician being no longer required.

The efforts required for a drive associated with a cassette are considerably smaller than when it is associated with the printer because it need be dimensioned only for the comparatively short life of a cassette. The initial cost for a printer inclusive of a cassette is reduced.

Although the cost of an exchangeable cassette provided according to the invention with an individual drive is slightly higher, this is not disadvantageous even after frequent use of the exchangeable cassettes because the saving due to reduced repair cost is of greater importance.

The ink ribbon cassette according to the invention must be electrically connected to a printer. This is possible in a simple manner in that the contact connection is established by means of plugs which are provided at the cassette and are inserted into associated counter-socket couplings of the printer in the case of a cassette inserted into the printer.

The electrical connection can be automatically established without additional efforts in that contact elements are provided which project resiliently from a cassette wall, are electrically connected to the electric motor and are in current-conducting contact with associated countercontact surfaces of the printer in the case of an inserted cassette.

The contact elements of the cassette are advantageously arranged in a plane parallel to its direction of insertion. The corresponding electrical contact surfaces can slide to a certain extent relative to each other so that any tolerance differences of the cassette position are admissible without the current connections being adversely affected.

It is preferably ensured for a cassette held so as to be pivotable about a pivot shaft space-bound with respect to the printer that the contact surfaces of the cassette are arranged in a plane orthogonal to the pivot shaft in the proximity of the pivot shaft. A displaceability of the contact connection within very narrow limits is then sufficient.

BRIEF DESCRIPITON OF THE DRAWINGS

FIG. 1 shows diagrammatically the features essential to the invention of an ink ribbon cassette, FIG. 2 is a plan view of an opened drive housing of an ink ribbon cassette according to the invention, FIG. 3 is a sectional view of the drive housing shown in FIG. 2, FIG. 4 shows a cut-out part of the arrangement shown in FIG. 2 illustrating the electrical connections.

DETAILED DESCRIPTION OF THE PREFERRED EMBODIMENTS

Figure 1:
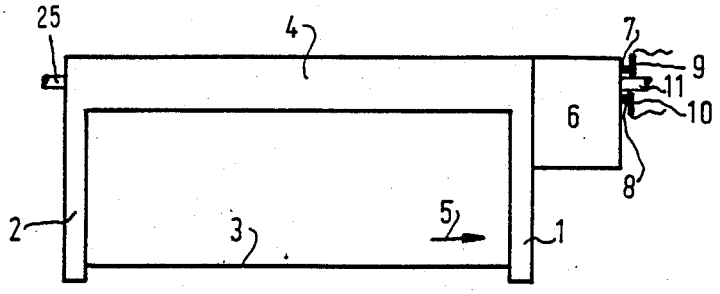

In FIG. 1, a section of an ink ribbon 3 extends in the region between side arms 1 and 2, a great length of this ink ribbon being stored in a storage space 4.

The ink ribbon 3 is further moved in the direction of the arrow 5 by means of a drive, which is provided in the integrated drive housing 6.

Reference numerals 7 and 8 designate slide contacts, which are electrically connected to a motor of the driving device and slide over countercontact surfaces 9 and 10 of a printer with resilient pressure so that a rotary movement of the ink ribbon cassette about rotary shafts 11 and 25 is possible whilst maintaining the electrical contact.

Since electric motors used for the driving device 6 are generally low-voltage motors, the contact surfaces 9 and 10 need not comprise means for protection against touching.

Figure 4:
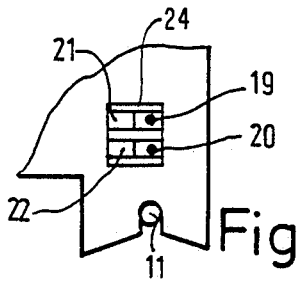
Figure 3:
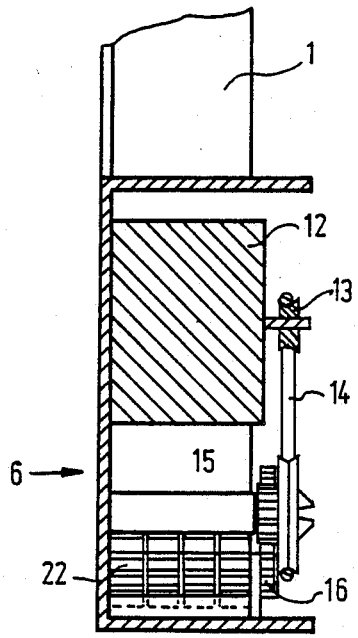
Figure 2:
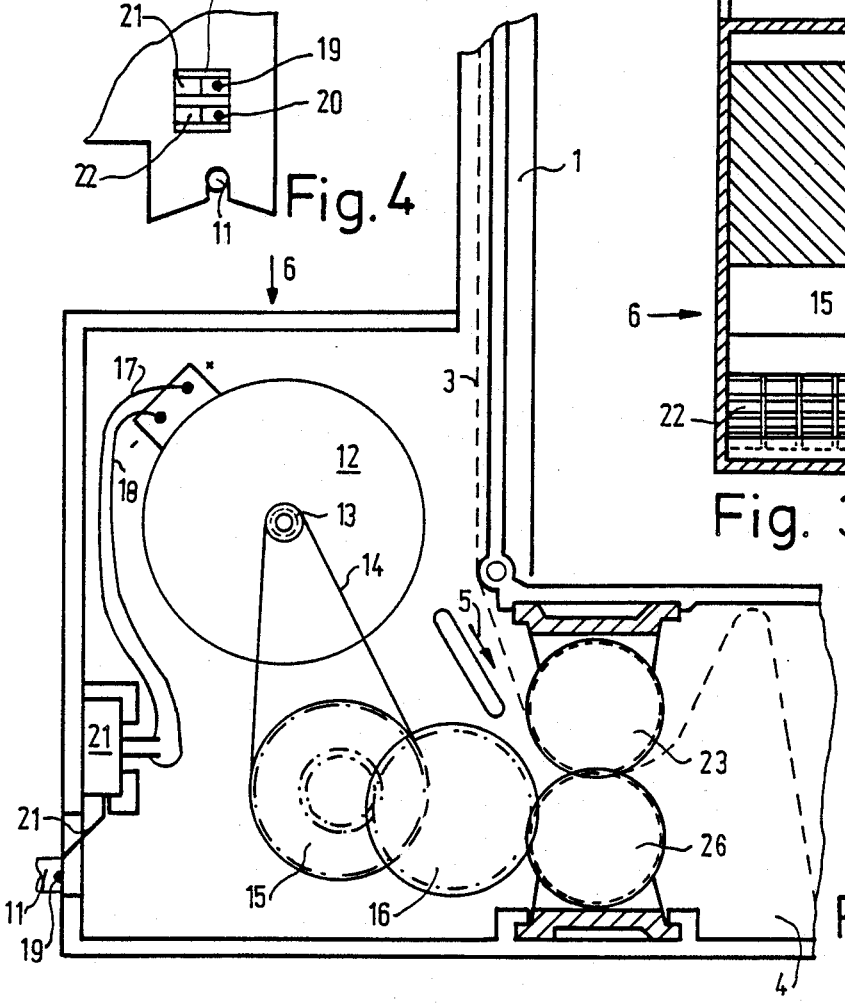

Details of a drive constructed in accordance with the invention for an ink ribbon cassette are shown in FIGS. 2 to 4. In the drive housing 6 shown without a cover and made in one piece with the ink ribbon cassette, a motor 12 operated with a direct voltage of less than 12 V drives with its belt pulley 13 through the toothed belt 14 the toothed wheels 15 and 16 of a reduction driving gear. The toothed wheel 16 meshes with the transport roller 26, upon whose rotation the ink ribbon 3 clamped between the transport rollers 22 and 26 is pulled.

The toothed wheels 15 and 16 may advantageously be formed on the bottom wall of the drive housing 6. The connection leads 17 and 18 extending from the electric motor 12 are connected to slide contacts 19 and 20, which project from spring arms 21 and 22 of a contact support 24. The slide contacts 19 and 20 are arranged in the immediate proximity of the rotary shaft 11 so that their slide movement when pivoting the ink ribbon cassette is a minimum.

What is claimed is:

1. An exchangeable ink ribbon cassette for a printer comprising:

a ribbon housing, removable from the printer, having a storage space containing a length of ink ribbon;

a drive housing fixedly connected to said ribbon housing, said drive housing supporting a motor drivingly coupled to ribbon transport means within said ribbon housing which moves said ribbon from said storage space to an operating position, said drive housing containing on the outside thereof first and second electrical contacts electrically connected to said motor driven ribbon transport means; and, first and second pivot supports for supporting said ribbon and drive housings in engagement with said printer, and positioning said first and second electrical contacts in engagement with corresponding contacts on said printer which supply said motor with electrical current.

2. The exchangeable ribbon cassette of claim 1 wherein said first and second contacts comprise sliding contacts which slide over said corresponding contacts.

3. The exchangeable ribbon cassette of claim 1 wherein said first and second electrical contacts resiliently project from said cassette.

4. The exchangeable ribbon cassette of claim 3 wherein said first and second electrical contacts lie in a plane parallel to the direction of insertion of said cassette into said printer.

5. The ribbon cassette of claim 4 wherein said first and second electrical contacts are located adjacent one of said pivot supports lying in a plane perpendicular to an axis of said pivot support.

* * * * *